US011073361B1

(12) United States Patent
Grigsby et al.

(10) Patent No.: US 11,073,361 B1
(45) Date of Patent: Jul. 27, 2021

(54) MODULAR BALLISTIC WALL

(71) Applicant: Advanced American Technologies, LLC, Knoxville, TN (US)

(72) Inventors: Robert Grigsby, Owens Cross Roads, AL (US); Shannon McCall, Lacy's Spring, AL (US)

(73) Assignee: Advanced American Technologies, LLC, Knoxville, TN (US)

( * ) Notice: Subject to any disclaimer, the term of this patent is extended or adjusted under 35 U.S.C. 154(b) by 0 days.

(21) Appl. No.: 16/418,210

(22) Filed: May 21, 2019

Related U.S. Application Data

(60) Provisional application No. 62/674,142, filed on May 21, 2018.

(51) Int. Cl.

| | |
|---|---|
| ***F41H 5/24*** | (2006.01) |
| ***F41H 5/26*** | (2006.01) |
| ***F41H 5/06*** | (2006.01) |
| *B65D 19/00* | (2006.01) |

(52) U.S. Cl.
CPC ..... *F41H 5/26* (2013.01); *F41H 5/06* (2013.01); *B65D 19/0002* (2013.01)

(58) Field of Classification Search
CPC ... F41H 5/24; F41H 5/06; F41H 11/00; E04H 9/10; E04H 9/04
See application file for complete search history.

(56) References Cited

U.S. PATENT DOCUMENTS

| | | | | |
|---|---|---|---|---|
| 2005/0044804 | A1* | 3/2005 | Bin | E04B 1/3445 52/79.5 |
| 2006/0243690 | A1* | 11/2006 | Mollard | H05K 5/02 211/151 |
| 2008/0127865 | A1* | 6/2008 | Tung-Cheng | B65D 19/12 108/56.3 |
| 2013/0019742 | A1* | 1/2013 | Lecarpentier | E04H 9/06 89/36.02 |

* cited by examiner

*Primary Examiner* — J. Woodrow Eldred
(74) *Attorney, Agent, or Firm* — Angela Holt; Ryan J. Letson; Bradley Arant Boult Cummings LLP

(57) ABSTRACT

A modular ballistic wall system uses a military standard shipping pallet as a floor. A wall frame is rotatably affixed to the pallet. The wall frame receives and supports a plurality of modular ballistic wall panels. The wall frame folds down against the pallet when the system is in a stowed position, e.g., during transport. The wall frame is generally perpendicular to the pallet when the system is in a deployed position. The modular ballistic wall panels can be solid metal ballistic panels, ballistic panels with firing ports, or ballistic glass.

16 Claims, 11 Drawing Sheets

MODULAR BALLISTIC WALL

REFERENCE TO RELATED APPLICATIONS

This application claims priority to Provisional Patent Application U.S. Ser. No. 62/674,142, entitled "Modular Ballistic Wall" and filed on May 21, 2018, which is fully incorporated herein by reference.

BACKGROUND & SUMMARY

A rapidly deployable ballistic wall system is transported on and uses a standard 463L pallet that is used for transporting air cargo. A wall frame is rotatably affixed to the pallet and deploys and is populated with ballistic panels to form a wall that resists armor-piercing rounds. The ballistic panels are predominantly solid panels, though some have firing ports and some have clear ballistic glass.

DETAILED DESCRIPTION

Figure 1:
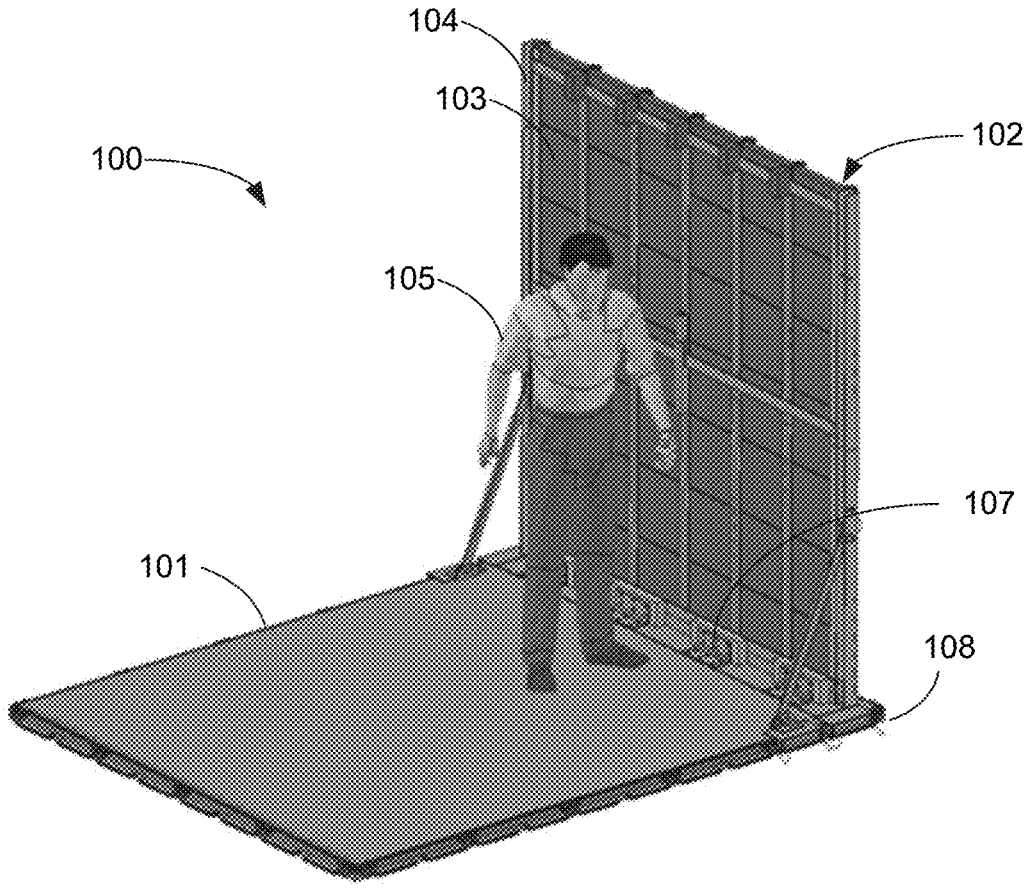
FIG. 1 depicts a modular ballistic wall system according to an exemplary embodiment of the present disclosure.

FIG. 1 depicts a modular ballistic wall system 100 according to an exemplary embodiment of the present disclosure. The system 100 comprises a ballistic wall 102 rotatably affixed to a pallet 101.

The pallet 101 comprises a 463L pallet, also known as a HCU-6/E pallet, which is a standardized pallet used for transporting military air cargo. In the system 100, the pallet 101 is used to support and contain the system components during transport, and also serves as the floor for the ballistic wall system 100 during use of the system 100, as further discussed herein.

The ballistic wall 102 comprises a frame 104 that is rotatably secured to the pallet 101 at an edge 108 of the pallet 101. The frame 104 is secured to the pallet via a plurality of hinges 107. During transport of the system 100, the frame 104 is folded down such that the frame rests adjacent to and atop the pallet 101. The frame 104 is raised to a position generally 90 degrees to the pallet 101 when the system 100 is deployed.

The frame 104 receives and supports a plurality of modular ballistic wall panels 103 that prevent armor-piercing rounds from penetrating the wall 102. The modular ballistic wall panels 103 may comprise solid ballistic panels, ballistic panels with firing ports, or ballistic glass, as further discussed herein. All of the wall panels 103 are the same size and general shape and fit in the frame 104 such that the wall 102 can be customized with panels, firing ports, and windows, all designed to resist armor-piercing rounds.

Figure 2:
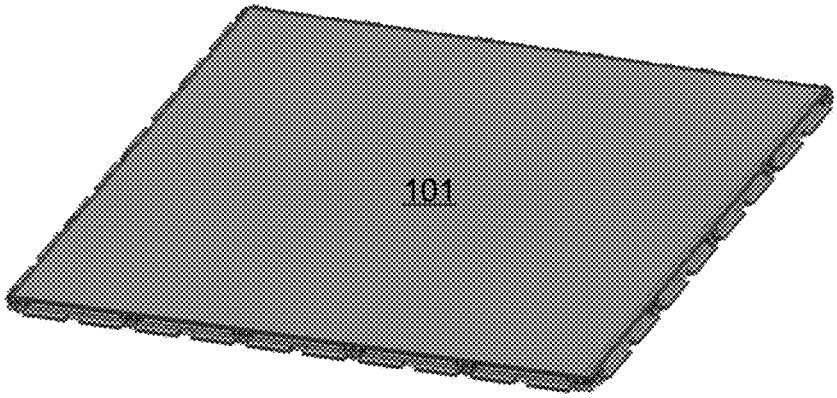
FIG. 2 depicts a pallet according to an exemplary embodiment of the present disclosure.

FIG. 2 depicts a pallet 101 according to an exemplary embodiment of the present disclosure. In this example, each pallet 101 is 108 inches long, 88 inches wide, and 2.25 inches high. Nets (not shown) secure cargo during transport of a loaded pallet 101. Multiple pallets 101 are connected side by side to form a floor (not shown) in the system 100 (FIG. 1), as further discussed herein.

Figure 3:
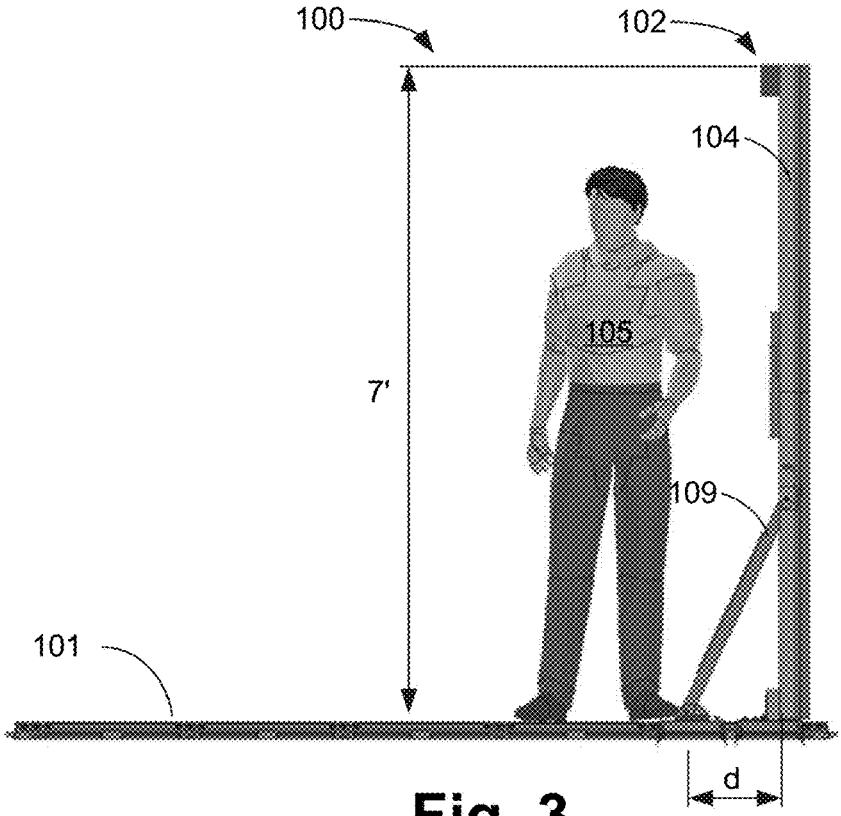
FIG. 3 is a side view of the system FIG. 1.

FIG. 3 is a side view of the system 100 of FIG. 1. The wall 102 is seven feet high in one embodiment, to protect a human 105. The system is designed to protect personnel when equipped with boots and helmet up to T tall.

The wall 102 is braced with a plurality of braces 109. The braces 109 connect at an upper end to the frame 104 and at a lower end to the pallet 101. The braces 109 extend from the frame 104 a horizontal distance "d," which is substantially one foot in one embodiment.

Figure 4:
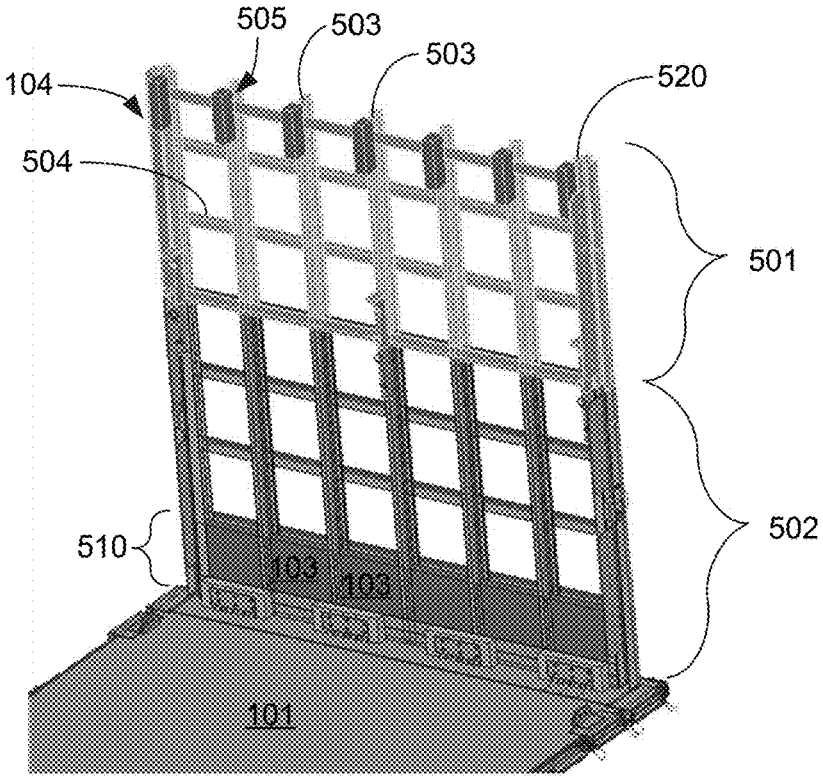
FIG. 4 is a perspective view of the frame attached to the pallet.

FIG. 4 is a perspective view of the frame 104 attached to the pallet 101 before all of the ballistic panels 103 have been installed in the frame 104. In this figure, only a bottom row 510 of panels 103 have been installed. The frame 104 comprises a plurality of vertical supports 503 and a plurality of horizontal supports 504, "vertical" and "horizontal" here referring to the position when the frame is deployed. The vertical supports 503 comprise recesses 505 that receive opposed side edges (not shown) of the ballistic panels 103. The recesses 505 support the ballistic panels 103 within the frame 104. The horizontal supports 504 are rigidly affixed to the vertical supports 503 to provide support for the frame 104.

To install the ballistic panels 103 in the frame 104, the installer (not shown) inserts the panels 103 into the recesses, at the top edge 520 of the frame 104, and slides the panes 103 within the recesses down to the bottom of the frame, forming rows of panels 103 stacked atop of one another.

In the illustrated embodiment, the frame 104 will hold seven (7) rows of panels 103, each row comprising six (6) panels. Other embodiments comprise more or fewer panels 103.

Further, in this embodiment, the frame 104 comprises a top portion 501 releasably affixed to bottom portion 502. While the frame 104 is generally shipped on the pallet 101 with the top portion 501 affixed to the bottom portion 502, the frame 104 breaks down into the top portion 501 and bottom portion 502 if needed to aid in transporting the frame 104 through tight spaces, e.g., stairwells and the like. Removing the top portion 501 further reduces the weight of the pallet 101 and frame 104 during deployment.

The system 100 is designed such that 95th percentile personnel can set-up, tear down, and repackage the entire system for redeployment. Further individual system components are transportable by two personnel up/down a flight of stairs.

FIG. 4 shows that a bottom row of modular ballistic panels 103 have been installed in the frame 104. It may be desired to have some of the panels 103 installed into the frame during transport of the system 100. Other panels 103 may be installed during deployment.

Figure 5:
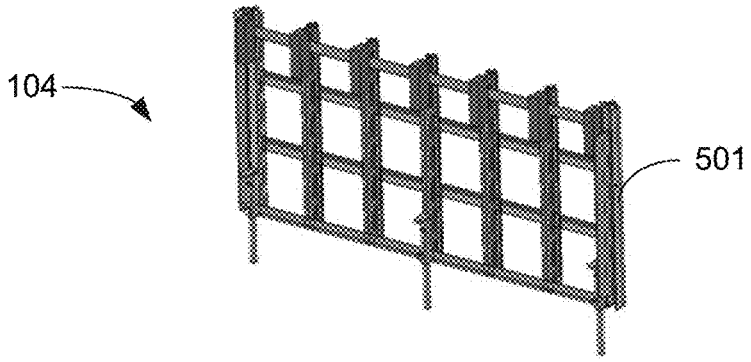
FIG. 5 depicts the removable top portion of the frame.
Figure 6:
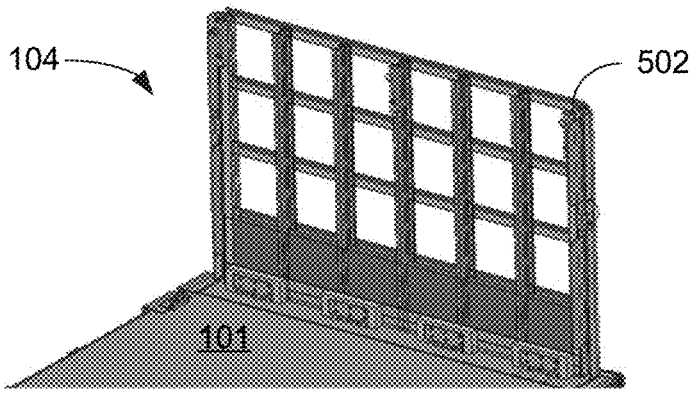
FIG. 6 illustrates the bottom portion of the frame with the top portion removed.

FIG. 5 illustrates the top portion 501 of the frame 104 removed from the bottom portion 502 (FIG. 6) of the frame 104, as discussed above. FIG. 6 depicts a bottom portion 502 of the frame 104 without the top portion 501 (FIG. 5). In the illustrated embodiment, the top portion 501 receives three rows of panels (not shown), and the bottom portion 502 receives four rows of panels (not shown).

Figure 7:
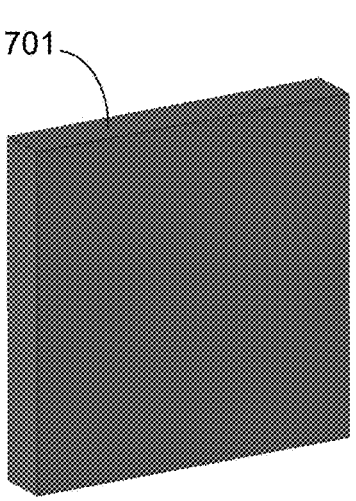
FIG. 7 depicts a solid ballistic panel.

FIG. 7 depicts a solid ballistic panel 701. The solid ballistic panel 701 is a multi-layer metal panel designed to prevent armor-piercing rounds from passing through the panel. In one embodiment, each panel is approximately one foot wide by one foot high, and 1.9 inches thick.

Figure 8:
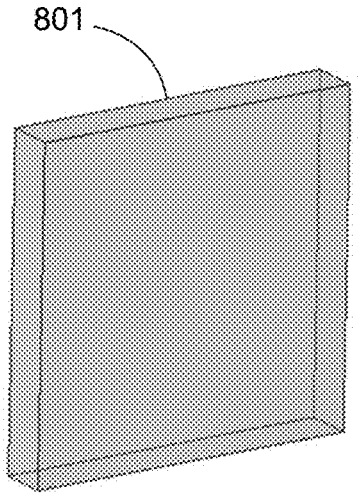
FIG. 8 depicts a transparent ballistic glass panel.

FIG. 8 depicts a transparent ballistic glass panel 801. The glass panel 801 can be used as windows in the wall 102 (FIG. 1). The ballistic glass panel 801 is the same size and shape as the solid ballistic panel 701.

Figure 9A:
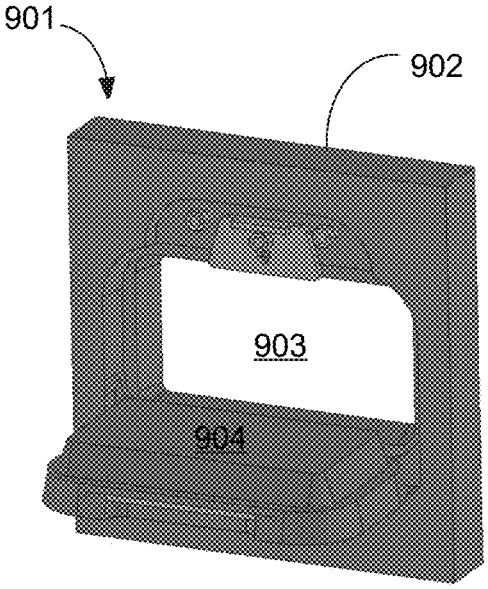
FIG. 9A depicts an inside view of a ballistic panel with firing port with the port open.
Figure 9B:
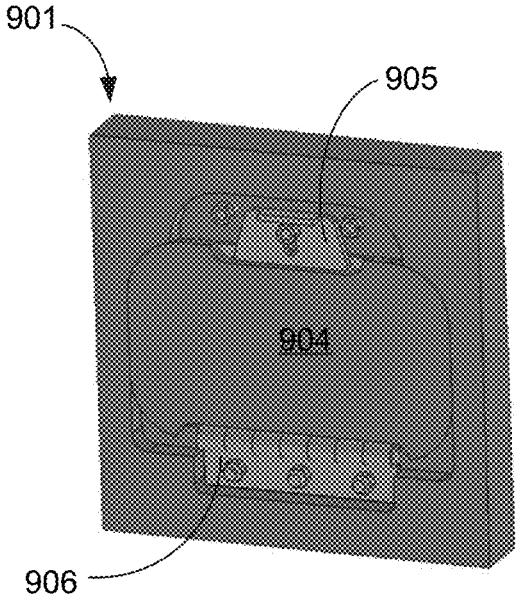
FIG. 9B depicts the panel of FIG. 9A with the firing port closed.
Figure 9C:
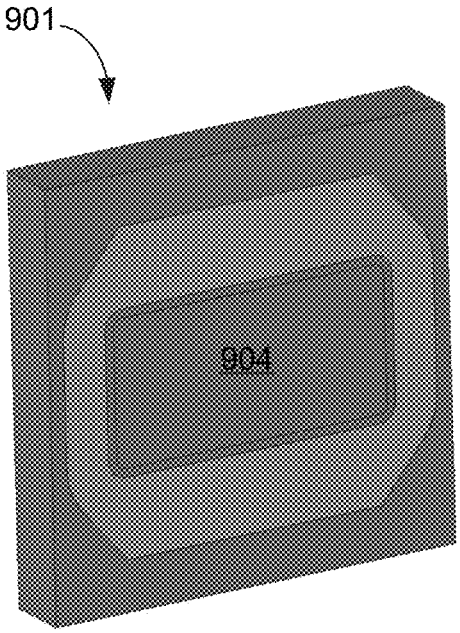
FIG. 9C depicts an outside view of the panel of FIG. 9A with the port closed.
Figure 9D:
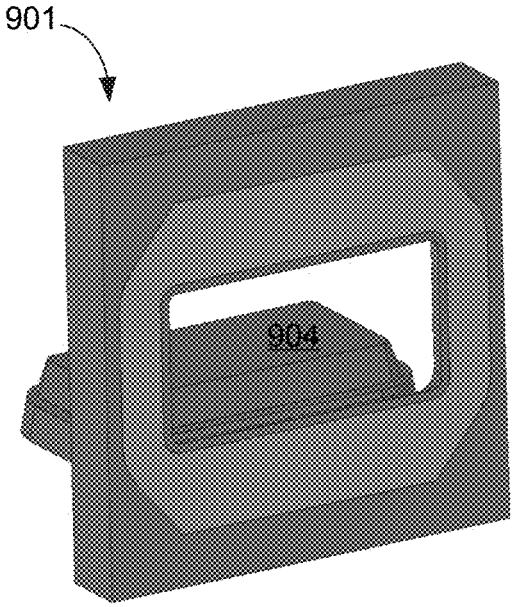
FIG. 9D depicts an outside view of the panel of FIG. 9A with the port open.

FIGS. 9A-9D depict various views of a ballistic panel with firing port 901. FIGS. 9A and 9B show the inside of the panel 901 and FIGS. 9C and 9D show the outside of the panel 901. The ballistic panel with firing port 901 is the same size and shape as the solid ballistic panel 801, but has an opening 903 for firing weapons through the panel. The opening 903 is sealed by a door 904 when not in use. The door 904 is hingedly affixed to the panel 901 with firing port 901 via a hinge 906 (FIG. 9B). In the illustrated embodiment, a latch 905 bolted to the panel 901 slides upward to release the door 904 for opening and slides downward to latch the door 904 when the door is closed. In other embodiments, other means of latching the door 904 to the panel 901 are used.

Figure 10:
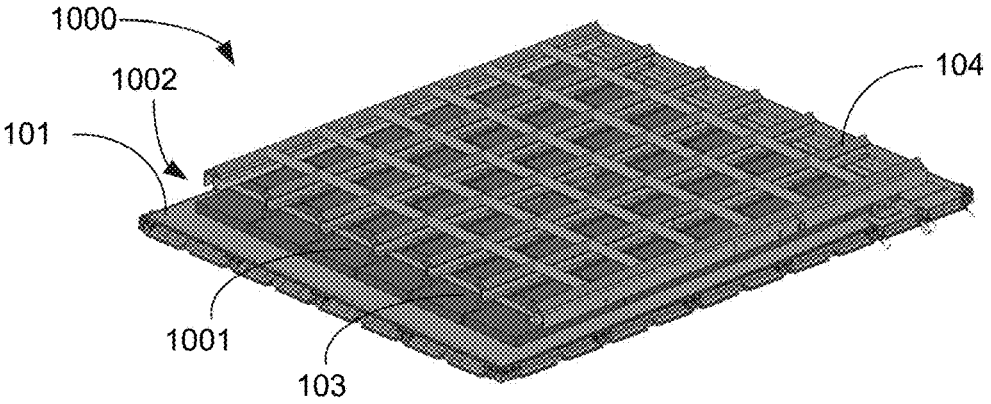
FIG. 10 depicts an undeployed system in transport configuration, according to an exemplary embodiment of the present disclosure.
Figure 11:
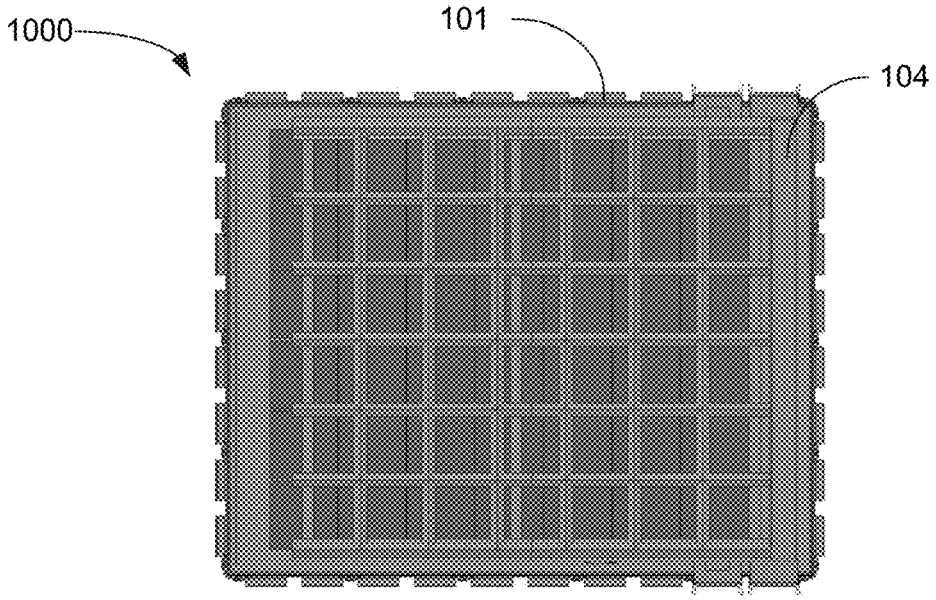
FIG. 11 is a top plan view of the system of FIG. 10.
Figure 12:
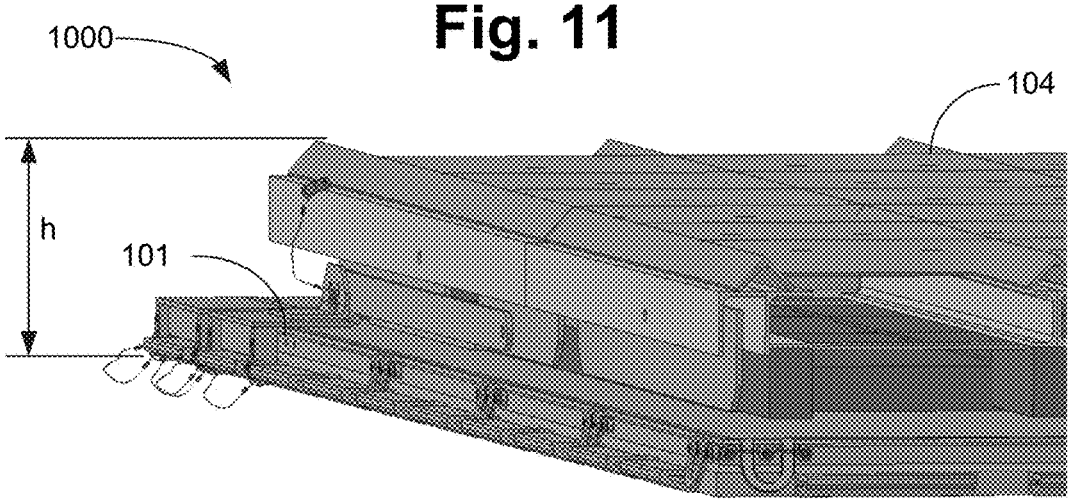
FIG. 12 is an enlarged perspective view of the system of FIG. 10.

FIGS. 10-12 depict an undeployed system 1000 according to an exemplary embodiment of the present disclosure, with the system 1000 in configuration for transport. In this configuration, the frame 104 is rotated downwardly until it is parallel to the pallet 101. When the frame 104 is rotated downwardly, a space 1002 is created between the frame 104 and the pallet 101. The space 1002 is wider than the thickness of the ballistic panels 103 such that ballistic panels 103 can be laid on top of the pallet 101 before the frame 104 is rotated down. Sandwiching the ballistic panels 103 between the frame 104 and the pallet 101 during transport of the system efficiently uses all available space in the transport configuration.

FIG. 11 is a top plan view of the system 1000 of FIG. 10. The system components when stowed on the pallet 101 during shipment fit within the footprint of the pallet 101.

FIG. 12 is an enlarged perspective view of the system 1000 of FIG. 10. The height "h" of the system 1000 is substantially 6.5 inches in one embodiment. The system 1000 is stackable, i.e., other systems, with pallet 101 and undeployed frame 104, may be stacked on top of a first system 1000 for transport.

Figure 13:
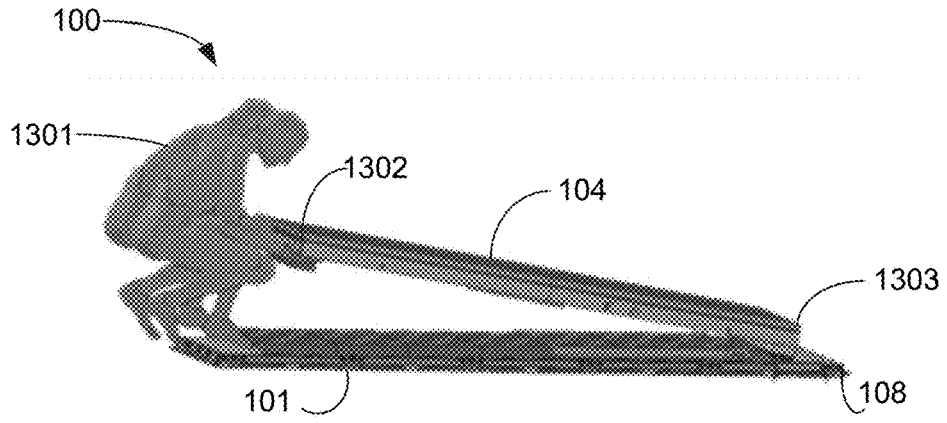
FIG. 13 illustrates personnel deploying a modular ballistic wall system.
Figure 14:
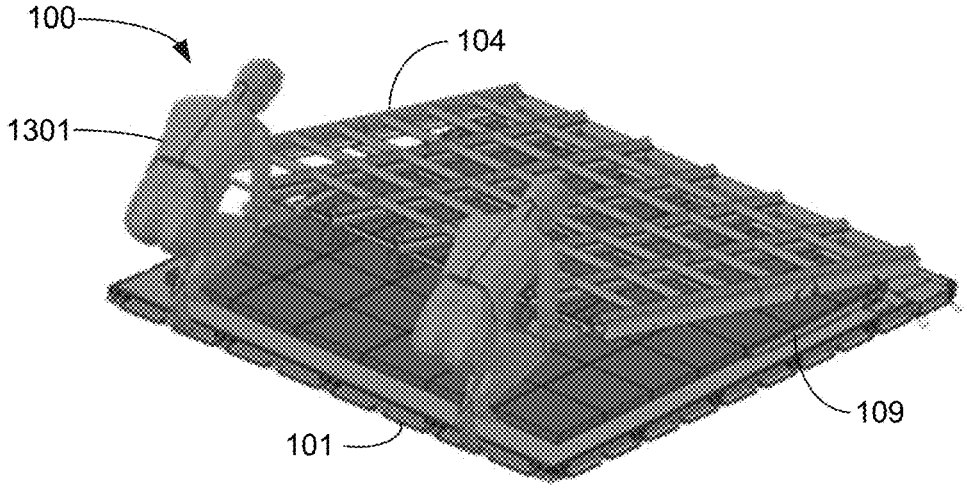
FIG. 14 is another view of the system of FIG. 13.

FIGS. 13-16 illustrate two personnel 1301 deploying the system 100 according to an exemplary embodiment of the present disclosure. In FIGS. 13 and 14, the personnel 1301 have begun lifting an upper edge 1302 of the frame 104 from the pallet 101. The frame 104 rotates upwardly about its lower edge 1303, which is hinged to the edge 108 of the pallet 101, as discussed above. FIG. 14 illustrates the braces 109 (one of which is shown in FIG. 14) in a stowed position, from which they will be rotated after the frame 104 is fully deployed.

Figure 15:
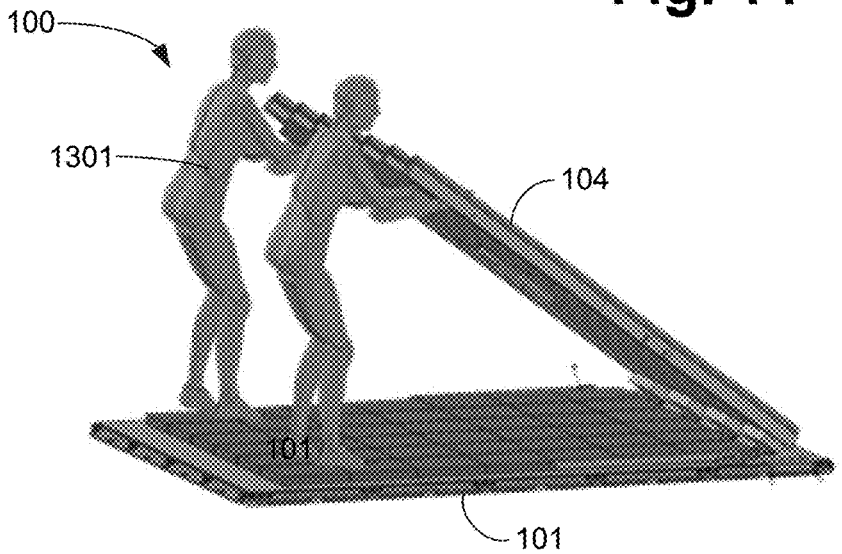
FIG. 15 further depicts the deployment of the system of FIG. 13.
Figure 16:
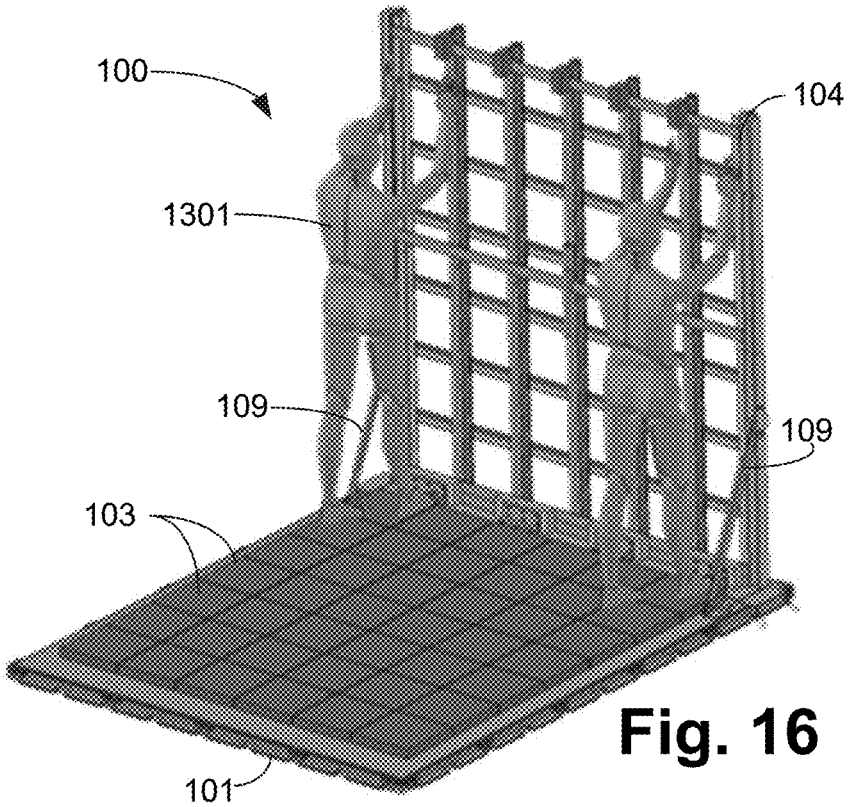
FIG. 16 depicts the frame of FIG. 13 in vertical configuration.

In FIG. 15, the personnel 1301 have lifted the frame 104 about 45 degrees. In FIG. 16, the personnel 1301 have lifted the frame 104 a full 90 degrees to its deployed position. The braces 109 are then rotated upwardly and connected to the frame 104 to support the frame 104.

Figure 17:
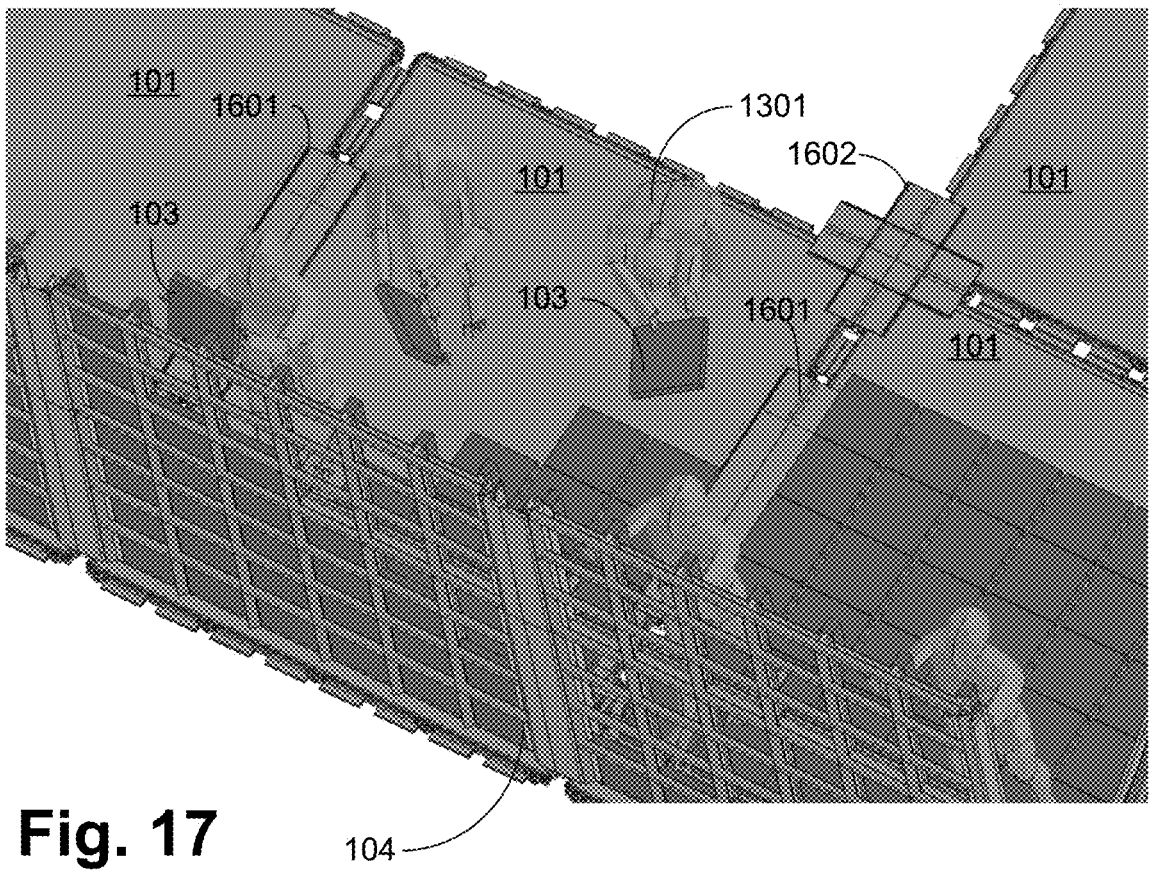
FIG. 17 illustrates multiple pallets and frames interconnected together to create a protected area.

FIG. 17 illustrates multiple pallets 101 and frames 104 interconnected together to create a protected area. In this regard, pallets 101 are placed side by side and connected together with edge gap connectors 1601 and four-way gap connectors 1602. Quick disconnect pins are generally used to make the connections.

FIG. 17 further illustrates personnel 1301 removing ballistic panels 103 from the pallets 101 (where they were placed during transport) and installing them into the frames 104, as discussed herein.

Figure 18:
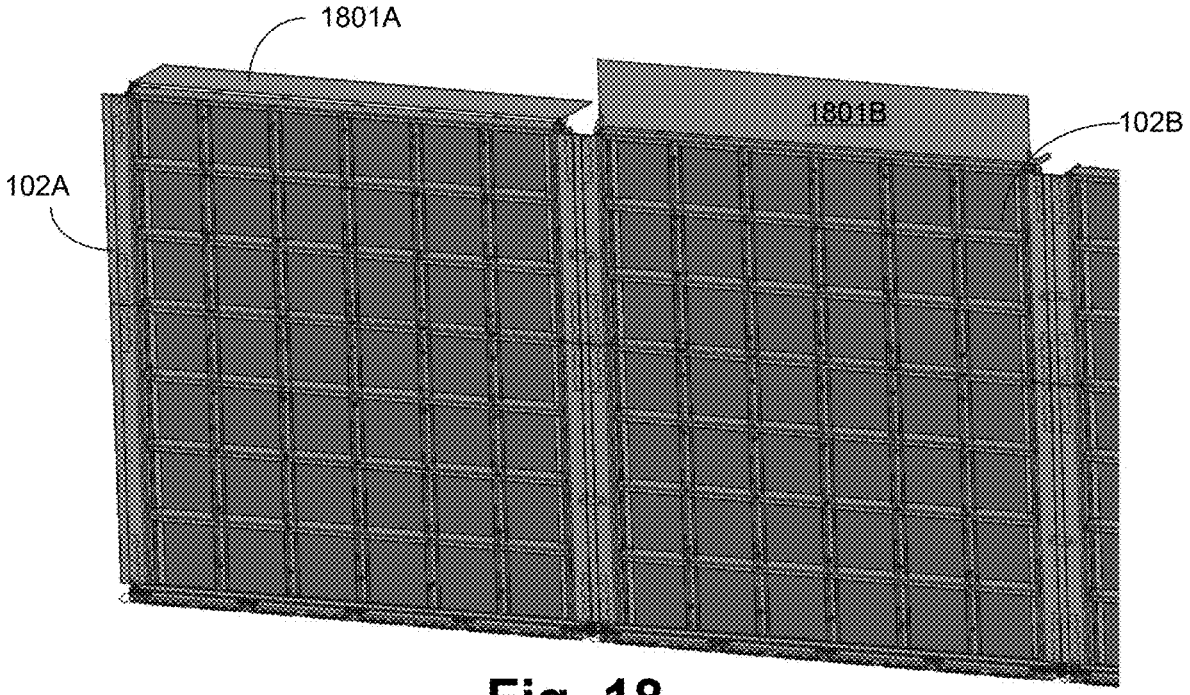
FIG. 18 depicts two walls interconnected together.

FIG. 18 depicts two walls 102A and 102B interconnected together. A wall cap 1801A is installed at the top of the wall 102A and a wall cap 1801B is installed at the top of the wall 102B. The wall cap 1801A is rotated 90 degrees to the wall 102A, and the wall cap 1801B is in the same plane as the wall 102B. The wall caps are designed to deploy in either of these positions. The wall caps are formed from ballistic material to further protect occupants behind the wall.

Figure 19:
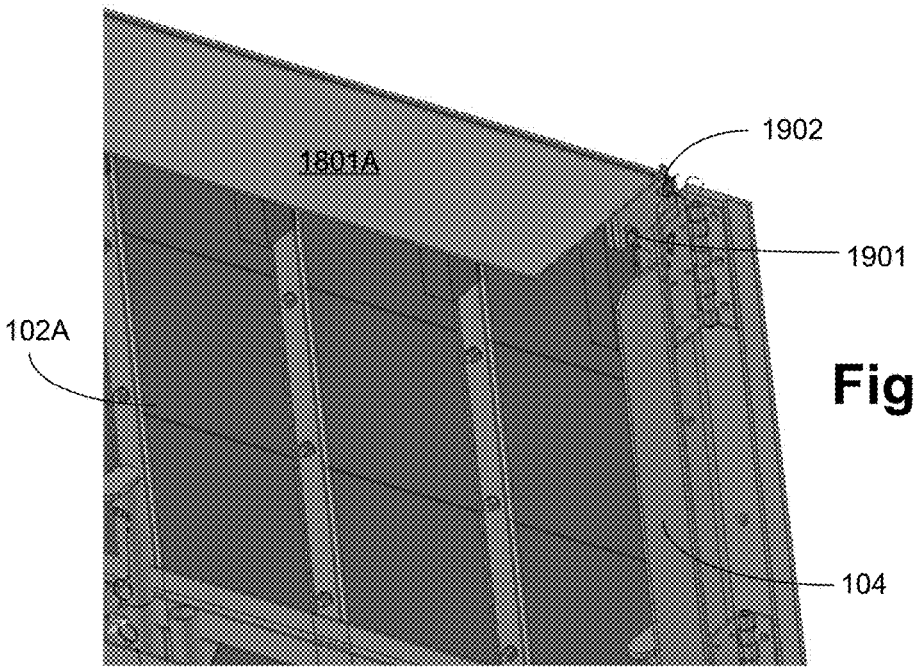
FIG. 19 is an enlarged view of the wall cap connected to the wall.

FIG. 19 is an enlarged view of the wall cap 1801A connected to the wall 102A. A pivot pin 1902 rotatably affixes the wall cap 1801A to the frame 104, such that the wall cap 1801A is rotatable from a horizontal to a vertical position. A locking pin 1901 fixes the wall cap 1801A at a ninety degree angle to the wall 102A, if desired.

Figure 20:
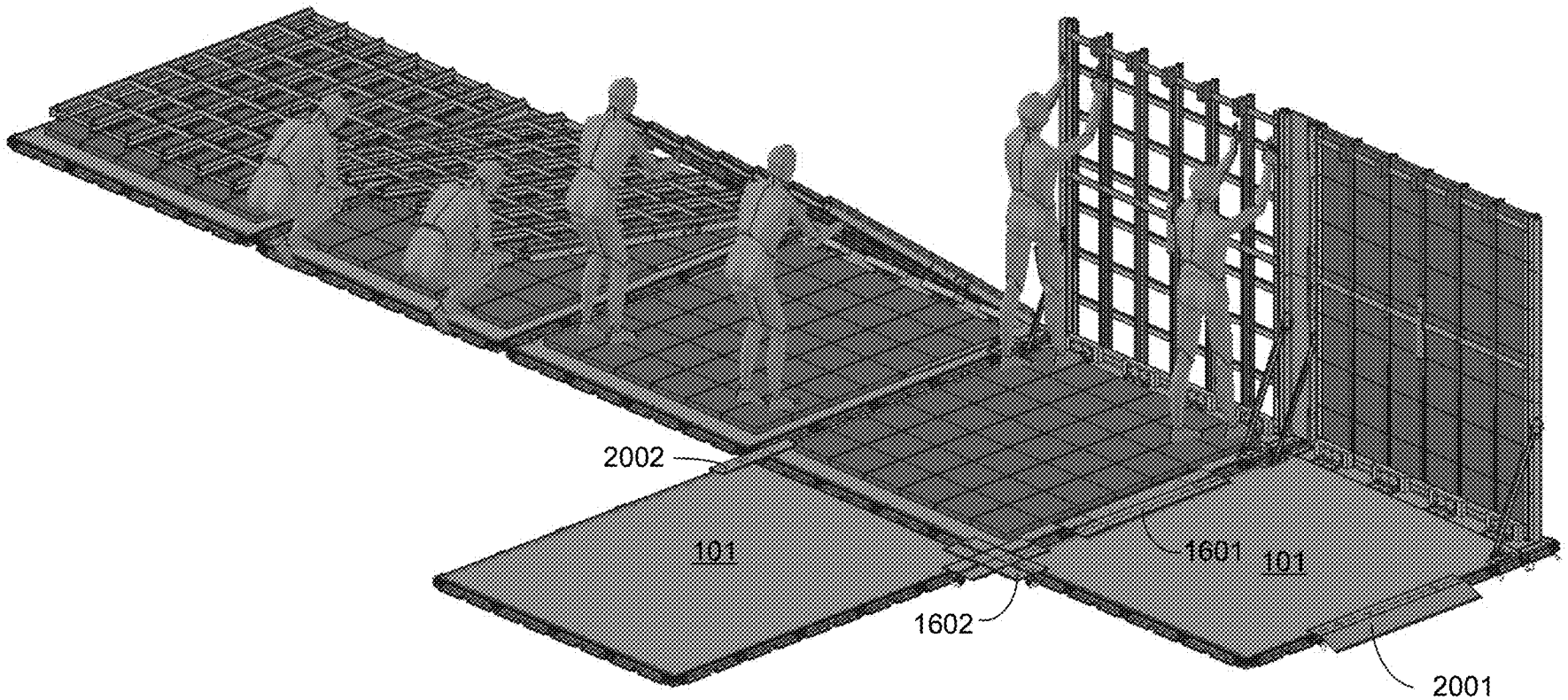
FIG. 20 further illustrates the deployment process.

FIG. 20 further illustrates the deployment process. As discussed above, four-way connectors 1602 connect four pallets 101 together at their corners. Edge gap connectors 1601 connect two pallets together at their edges. Further, side gap connectors 2002 connect two panels together at their side edges near the corners. Ramp connectors 2001 connect to an end panel where there is a height distance between the panel and the ground, to provide a ramp between the end panel and the ground.

Figure 21:
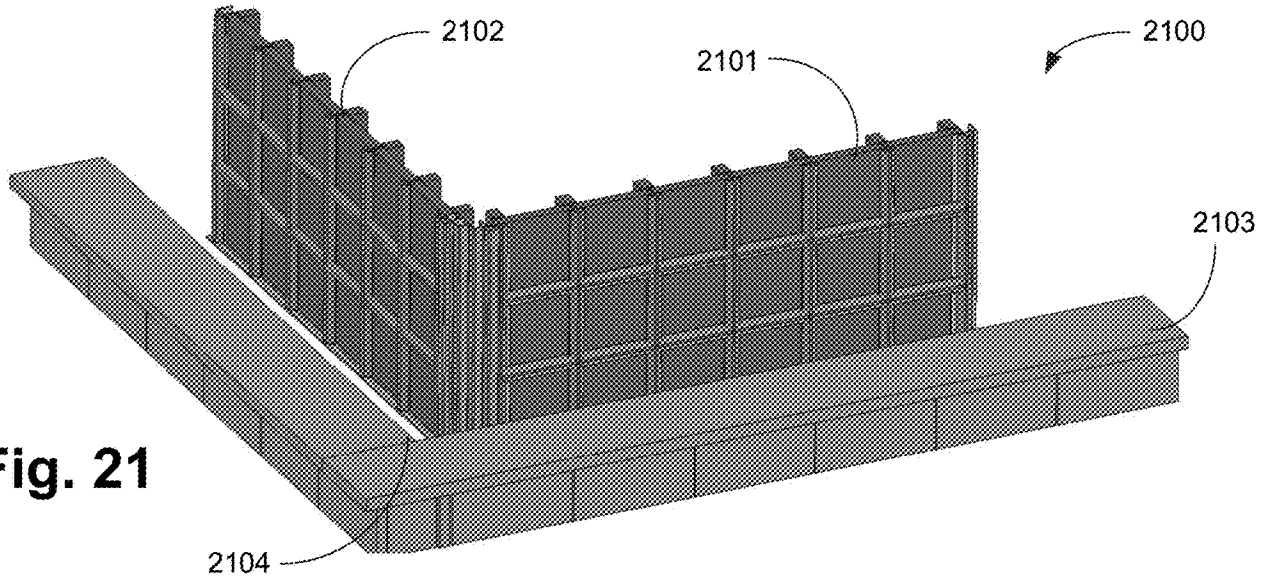
FIG. 21 is an outside view of a corner wall system.
Figure 22:
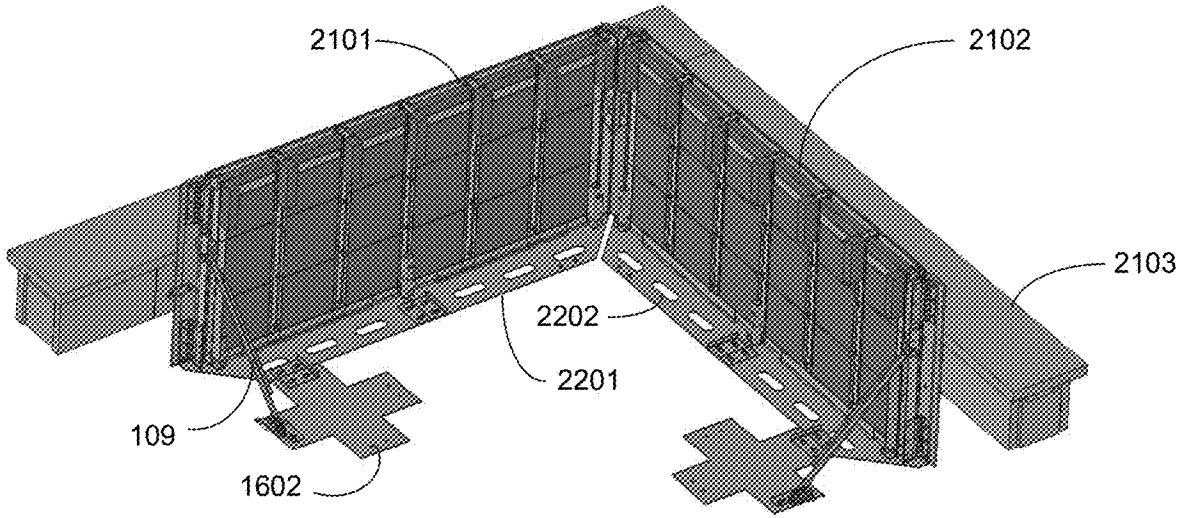
FIG. 22 is an inside view of the corner wall system of FIG. 21.

FIGS. 21 and 22 illustrates an alternative embodiment of a corner wall system 2100 used on a roof 2103. Walls 2101 and 2102 are shown connected together at a corner 2104 of the roof 2103. In this embodiment, the walls 2101 and 2101 are perpendicular to one another. FIG. 21 is an outside view of the corner wall system 2100 and FIG. 22 is an inside view of the corner wall system 2100.

In this embodiment, the pallets 101 (FIG. 1) are not always used as a floor; instead the floor of the roof suffices. Base plates 2201 and 2202 provide support for the walls 2101 and 2102. Four way connectors 1602 are connected to the base plates 2201 and 2202 for additional support. The braces 109 attach to the four way connectors 1602 as shown.

Figure 23:
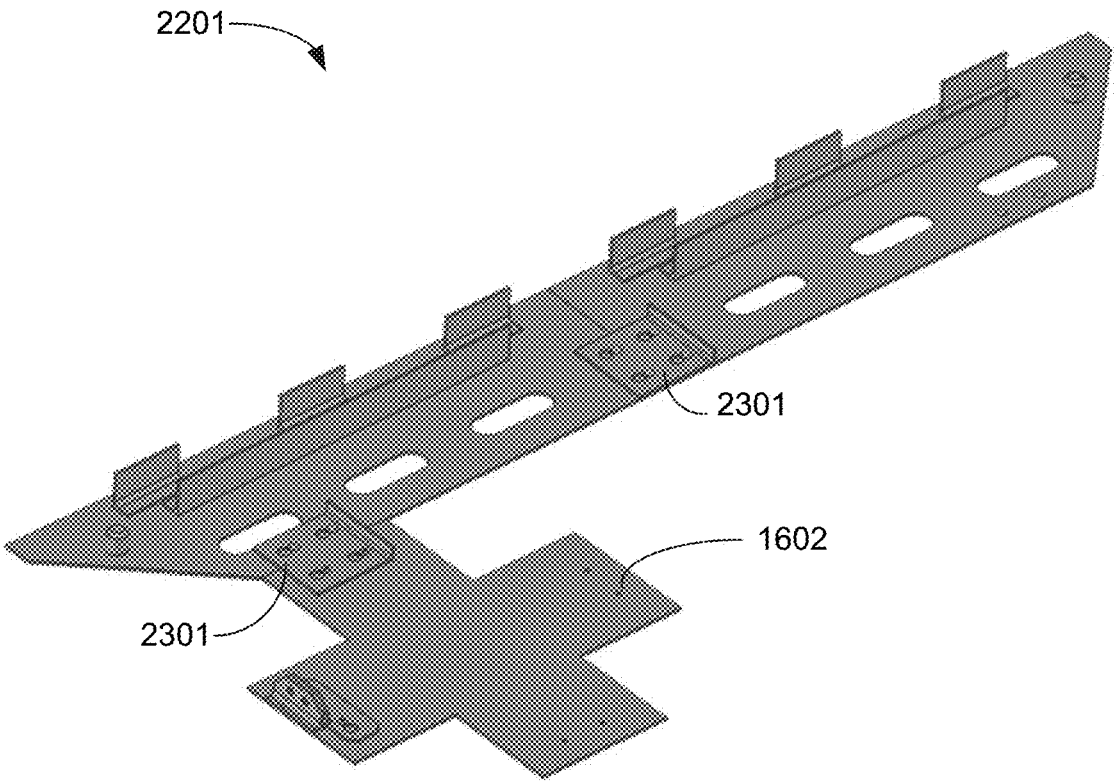
FIG. 23 is an enlarged view of a base plate.

FIG. 23 is an enlarged view of the base plate 2201. Key lock attachment plates 2301 connect the base plate 2201 components together, and connect the base plate 2201 to the four way connectors 1602. The key lock attachment plates provide for quick assembly of the base plate 2201.

The system disclosed herein is designed primarily for outdoor use, and therefore, can be subjected to all weather conditions and dirty environments.

What is claimed is:

1. A modular ballistic wall system comprising:

a pallet rotatably affixed to a wall frame, the pallet comprising a floor portion for the modular ballistic wall system, the wall frame configured to rotate about a first axis to a first position that is substantially parallel to and adjacent to the pallet when the wall system is in a stowed position, the wall frame configured to rotate about the first axis to a second position that is substantially perpendicular to the pallet when the wall system is in a deployed position, the frame receiving and supporting a plurality of removable modular ballistic wall panels.

2. The system of claim 1, the wall frame and pallet configured such that when the wall frame is in the stowed position, a space is created between the wall frame and the pallet, the space comprising a thickness larger than the thickness of the ballistic wall panels, the space enabling the ballistic wall panels to be placed between the wall frame and the pallet during shipment.

3. The system of claim 1, wherein the wall frame comprises a first plurality of support members oriented substantially perpendicular to the pallet when the wall frame is in the second position and a second plurality of support members oriented substantially parallel to the pallet when the wall frame is in the second position, the first plurality of support members comprising recesses configured to receive opposed side walls of the ballistic wall panels and to support the panels within the wall frame.

4. The system of claim 1, wherein the pallet is a military pallet.

5. The system of claim 1, wherein the ballistic wall panels comprise solid ballistic panels, ballistic panels with firing ports, or ballistic glass.

6. The system of claim 1, wherein the frame is comprised of a removable top portion releasably affixed to a bottom portion.

7. The system of claim 1, further comprising a wall cap affixed to a top edge of the wall frame, the wall cap rotatable about a second axis that is substantially perpendicular to the first axis.

8. The system of claim 5, wherein a solid ballistic panel comprises a multi-layer metal panel configured to prevent armor-piercing rounds from passing through the pane.

9. The system of claim 1, wherein multiple pallets are interconnected together to create a protected area, the pallets connected side-by-side with edge gap connectors extending between two adjacent pallets.

10. The system of claim 1, wherein multiple pallets are interconnected together to create a protected area, where four pallets are connected together via a four-way gap connector.

11. The system of claim 1, wherein ramp connectors are connectable to the pallet to form a ramp between the panel and the ground.

12. A method for building a modular ballistic wall, the method comprising:

rotatably affixing a pallet to a wall frame such that the wall frame is configured to rotate about a first axis to a first position that is substantially parallel to and adjacent to the pallet when the wall is in a stowed position and such that the wall frame is configured to rotate about the first axis to a second position that is substantially perpendicular to the pallet when the wall is in a deployed position;

positioning the pallet on a surface such that the pallet becomes a floor;

rotating the wall frame about the first axis to the second position and securing the wall frame via braces;

installing modular ballistic wall panels in the frame by inserting each panel into recesses in vertical supports of the frame and sliding the panels within the recesses down the vertical supports, creating rows of ballistic wall panels stacked upon ballistic wall panels.

13. The method of claim 12, wherein the step of installing modular ballistic wall panels in the wall frame further comprises installing seven rows of panels, each row comprising six panels.

14. The method of claim 12, wherein the step of installing modular ballistic wall panels in the wall frame comprises installing solid metal ballistic panels.

15. The method of claim 12, wherein the step of installing modular ballistic wall panels in the wall frame comprises installing ballistic panels with firing ports.

16. The method of claim 12, wherein the step of installing modular ballistic wall panels in the wall frame comprises installing ballistic glass panels.

* * * * *